United States Patent [19]

George

[11] Patent Number: 4,544,996

[45] Date of Patent: Oct. 1, 1985

[54] UNDERWATER LIGHTING SYSTEM WITH GROUNDED RETURN LINE

[75] Inventor: Benjamin B. George, Santa Ana, Calif.

[73] Assignee: Tivoli Industries, Inc., Santa Ana, Calif.

[21] Appl. No.: 630,844

[22] Filed: Jul. 13, 1984

[51] Int. Cl.[4] ..... F21V 11/00

[52] U.S. Cl. ..... 362/238; 362/246; 362/311; 362/249; 362/368; 362/267; 362/375; 313/316; 313/580

[58] Field of Search ..... 362/225, 249, 267, 311, 362/368, 375, 238, 244, 246; 313/316, 578, 579, 580, 601

[56] References Cited

U.S. PATENT DOCUMENTS

| | | | |
|---|---|---|---|
| 3,116,884 | 1/1964 | Lowther | 362/267 |
| 3,192,379 | 6/1965 | De Garmo | 362/267 |
| 3,463,958 | 8/1969 | Smalley | 313/601 |
| 3,755,663 | 8/1973 | George, Jr. | 362/806 X |
| 3,829,729 | 8/1974 | Westlund, Jr. et al. | 313/579 |
| 4,156,894 | 5/1979 | Berry | 362/267 |
| 4,177,503 | 12/1979 | Anquetin | 362/320 X |
| 4,271,458 | 6/1981 | George, Jr. | 362/252 X |
| 4,312,028 | 1/1982 | Hamacher | 362/390 X |
| 4,413,311 | 11/1983 | Orenstein | 362/806 X |

*Primary Examiner*—Peter A. Nelson
*Attorney, Agent, or Firm*—Grover A. Frater

[57] ABSTRACT

Pools and spas formed with lamp house accommodating wall conformations below normal water level are fitted with a flexible tubing lamp house containing special lamps having a safety conductor ending unconnected in the interior of the lamp envelope. The lamp energizing circuits and a grounding circuit connected to the safety conductors of the lamps are disposed in the lamp house with a water insoluable, light transmitting electrical insulating material which serves to insulate the circuits and exclude water.

13 Claims, 10 Drawing Figures

FIG. 1
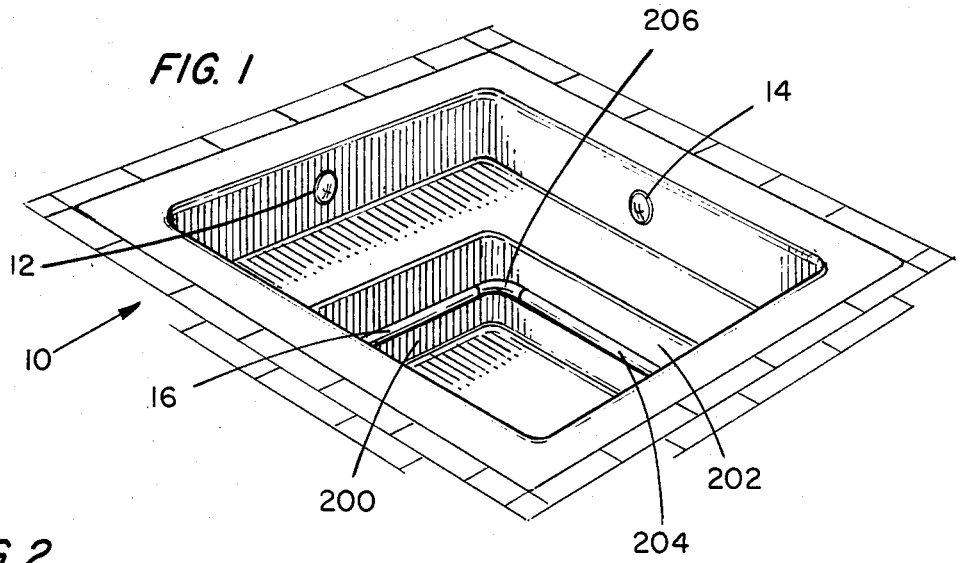
FIG. 2
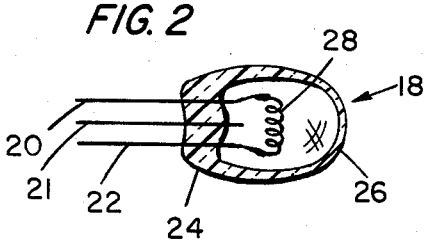
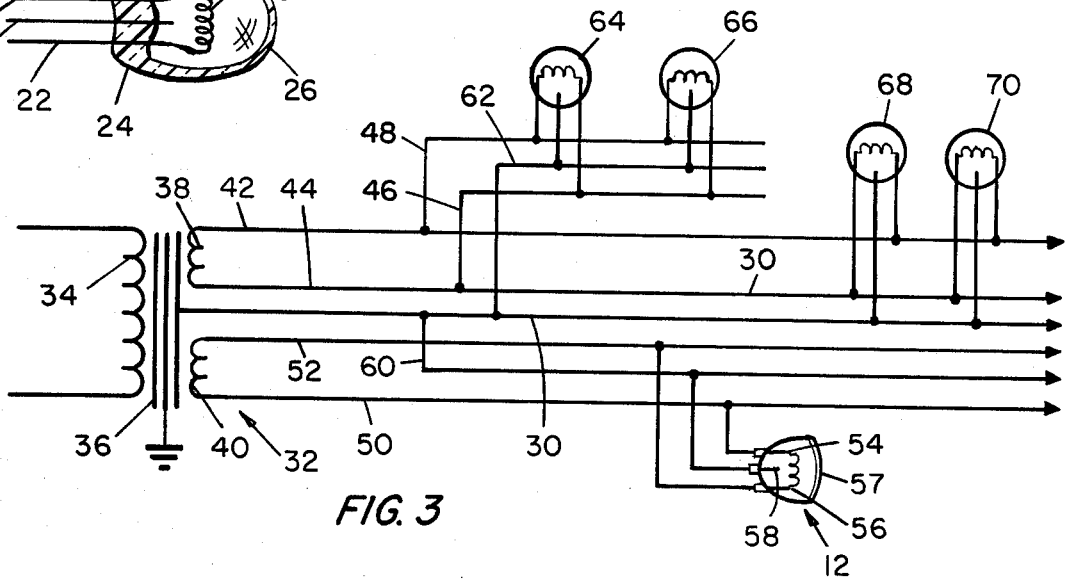
FIG. 3
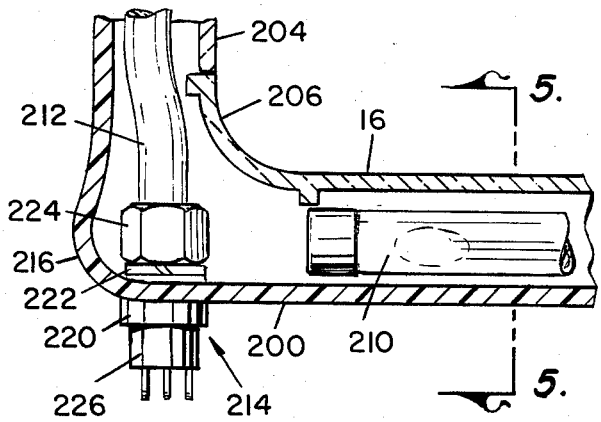
FIG. 4
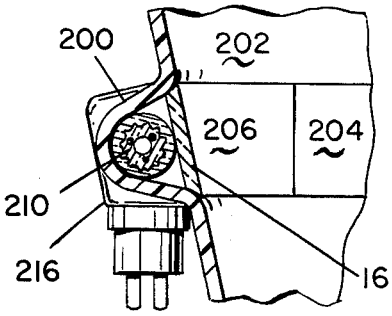
FIG. 5

FIG. 6
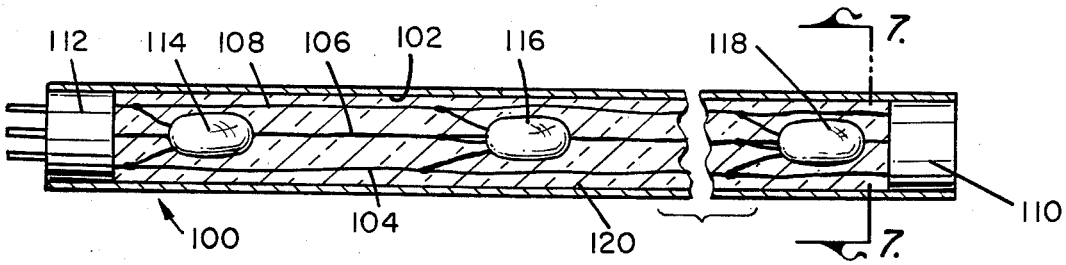
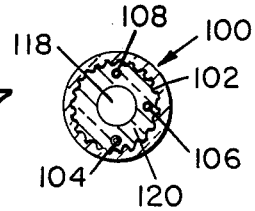
FIG. 7
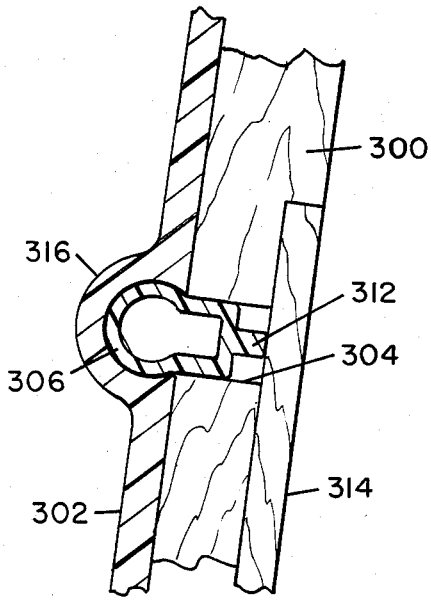
FIG. 8
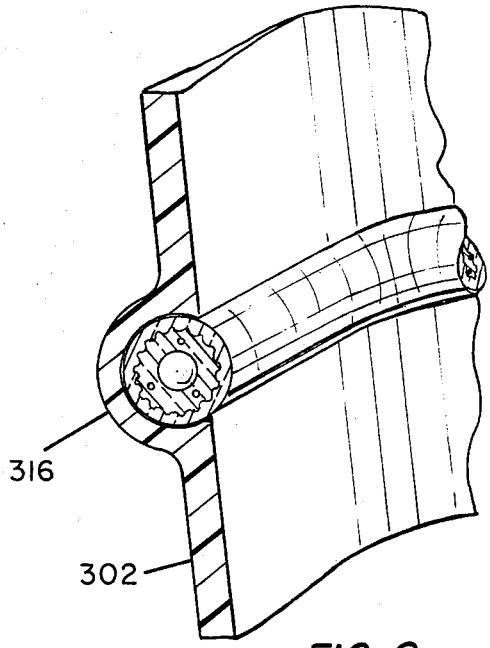
FIG. 9
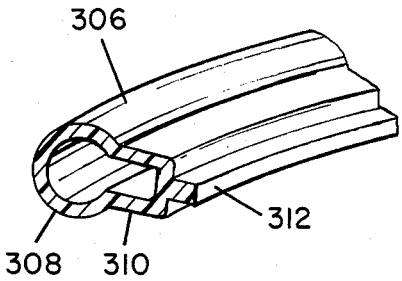
FIG. 10

UNDERWATER LIGHTING SYSTEM WITH GROUNDED RETURN LINE

TECHNICAL FIELD

This invention relates to improvements in underwater lighting systems and to lamps and lamp circuitry therefor.

BACKGROUND ART

Underwater lighting poses a number of problems which need not be faced in accomplishing most lighting tasks and that is particularly true when lighting swimming pools and spas. In most underwater lighting projects, and obviously in the case of pools and spas, the light source, the lamps, must be mounted in or behind the containing walls of the pool or spa, and the electrical wiring must be located behind those walls. The result is that there are wall openings. Openings give rise to opportunity for water leakage and consequent corrosion, for leakage and short circuit current flow, and for possible electrical shock to occupants of the pool or spa. The difficulty of creating a design that provides safety for the system and for users is multiplied by the need to provide for replacement of lamps.

The solutions of the past rely on special seals against passage of water to electrical connections and other elements of the electrical system, elaborate drains for discharging any leakage, and metal grounding screens and barriers to keep users from contact with electrical elements in the case of leakage and lamp breakage.

While the expedients of the past are effective to protect both lighting systems and pool and spa users, underwater lighting has generally been used only in public pools and in higher cost private pool construction, and not at all in private spas because of cost and maintenance difficulty.

The electrical codes of most jurisdictions require the inclusion of ground fault sensors in the energizing circuitry of underwater lighting systems. But those devices are easily bypassed. Many codes and insurance underwriters establish maximum current standards which must be met, with and without lamp breakage, when the ground fault sensor is removed or rendered inoperative. Those standards define maximum current levels in the pool and spa water at prescribed distances from electrical system components. The prior art solution has been to install physical barriers to prevent users from getting close to any electrical elements.

DISCLOSURE OF INVENTION

It is an object of the invention to provide an improved underwater lighting system, and a related object to provide a spa with improved underwater lighting.

Another object is to define a system of underwater lighting which provides full safety against electrical shock for pool and spa users without the need for grounding screens and similar structures.

A still further object is to provide an improved lamp housing, an improved electrical protective circuit, and improved lamps which are applicable to underwater lighting.

These and other objects and advantages of the invention, including cost and installation and maintenance advantages, which will become apparent upon examination of the accompanying drawings and the following specification, result in part from the incorporation of a grounding element which extends to the interior of the lamp itself and a special grounding circuit connected to the grounding element of the lamp. The combination of those features and of a tubular housing for both lamps and the grounding circuit, together with conformations in the pool or spa wall, combine to provide an improved pool spa unit.

The invention provides adequate lighting, both decorative and functional, with a minimum number of wall openings for reduced cost and increased safety. It makes feasible the use of greater numbers of smaller lamps and simplifies after-installation service. In one form of the invention, lamps are arranged at spaced points along the length of a tube serving as a common lamp house. The lamps include a safety conductor which terminates at the interior of the lamp envelope in close proximity to the power conductors. Lamps, energizing circuitry and a grounding line connected to the safety conductor of each lamp are all enclosed together in the tubular lamp house, and insulated from one another by a body of light transmissive electrical insulating material which is sufficiently solid to tend to preserve its form and structure in the event of an interruption in the integrity of the lamp house.

In the preferred form, a flexible, resilient plastic tube of polyurethane serves as the lamp house. The insulating material is resilient or pliant, and the conductor wires exhibit substantial flexibility. The result is that lamps can be mounted safely at the interior side of the pool or spa wall or as lane markers in swimming pools. The cost of incorporating the safety features of the invention is sufficiently low so that it is feasible to include those features in fountains and other underwater decorative applications where protection against electric shock is usually not considered to be cost effective.

BRIEF DESCRIPTION OF THE DRAWINGS

In the drawings:

FIG. 1 is an isometric view of a spa which incorporates flood lighting and perimeter lighting according to the invention;

FIG. 2 is a cross-sectional view of a lamp of preferred form in which the invention is embodied;

FIG. 3 is a schematic diagram of the electrical circuit arrangement employed in the lighting system of the spa of FIG. 1;

FIGS. 4 and 5 are cross-sectional views illustrating how the perimeter lighting tube is mounted on the inner wall of the spa;

FIG. 6 is a cross-sectional view of a length of perimeter lighting tube of the spa;

FIG. 7 is a cross-sectional view taken on line 7—7 of FIG. 6.

FIG. 8 is a cross-sectional view illustrating one of the final steps in creating a spa shell with a light tube retaining conformation in the form of a groove that is generally circular in cross-section;

FIG. 9 is a cross-sectional view of a portion of the spa shell with a light tube installed; and FIG. 10 is an isometric view of a section of an extrusion used in making the spa shell.

DESCRIPTION OF THE PREFERRED EMBODIMENT

The spa 10 of FIG. 1 is fitted with both flood lighting and perimeter lighting. Two of the flood lights, 12 and 14, are visible. The perimeter lights are not visible but are mounted behind a strip panel 16 a portion of which can be seen at a lower level in the spa. The lamps—flood lamps, perimeter lamps and spot lamps, if any—are all fitted with a safety conductor which extends through the wall of the lamp envelope and terminates, without internal connection, in close proximity to the conductors which supply energy to the lamp filament. At the exterior of the envelope the safety conductor is available for connection with the safety conductors of the other lamps to a common ground line.

An example is shown somewhat schematically in FIG. 2. The lamp shown in this figure is preferred for mounting in a tubular "lamp house" to be used in perimeter lighting. A glass annulus through which three conductor wires extend without touching one another is heated and melts and slumps to form a glass base. Two of the conductors are crimped at respectively associated ends of a filament wire. A glass tube is then heated, fused to the base and closed to complete an envelope. The result is seen in FIG. 2. The lamp 18 includes three conductor wires, 20, 21 and 22, which extend through the base 24 to the interior of the globe. Together the base and globe are called the envelope 26. Two of those conductor wires, 20 and 22, serve as power transmission lines. Their inner ends are crimped to the ends of a filament wire 28. Conductor wire 21 does not contact either of the other conductors or the filament.

The invention does not preclude the use of metal bases, but such bases are not necessary. If used, at least three connector terminals are required, any one of which may serve as the safety conductor.

One of the primary objectives of the invention is safety in the underwater environment. To accomplish that, the safety conductors of the several lamps are connected together to a common line which is grounded both to an electrical ground and, if there is one, to the plumbing system ground. In FIG. 3, the main ground line is numbered 30. Safety dictates low voltage, and to that end the power transmission lines to the lamps are supplied with energy through a step-down, isolation transformer 32. The transformer includes a primary winding 34, a core 36, and two secondary windings 38 and 40, respectively. In a typical case, and in this preferred case, the voltage across the secondary winding 38 and 40 is 24 volts r.m.s. In preferred form the lamps are connected in parallel with one another across the secondary winding if there is only one, or across one of the secondary windings if there are more than one. In FIG. 3 a pair of power transmission lines 42 and 44 are connected across secondary winding 38 in parallel with a second pair of power transmission line 46 and 48. A third pair of transmission lines 50 and 52 are connected across secondary winding 40.

The flood lamp 12 is shown schematically in FIG. 3 where its power conductors 54 and 56 are shown to be connected across filament 57. The safety conductor 58 is connected to a safety line 60, connected to safety line 30 which, in turn, is connected to transformer core 36 and electrical and plumbing system ground. Other lamps connected for energization from lines 50 and 52 have been omitted for the sake of clarity.

The perimeter lights of the preferred embodiment are arranged to be decorative and to provide some illumination near the bottom of the spa. Several lamps are connected at spaced points along a power transmission line, and both lamps and transmission line are contained in a lamp house of special form. Lamps and transmission lines, and the safety conductor line 1, are contained in, and are stretched along, the interior of an electrically insulating tube. The tube containing those elements is filled with a light transmissive material which is an electrical insulator. In preferred form the tube is made of flexible, resilient plastic, and it is filled with a flexible, resilient plastic. In this case, the tube is made of fully cured flexible, transparent polyurethane and the filler material is partially cured silicone. The silicone is cured enough so that it will tend to retain its shape if the outer tube material is torn away or cut. On the other hand, the filler material is sufficiently plastic to yield and damp vibration of the lamps and transmission and safety conductor lines.

The ends of the tube are plugged to seal the tube against the entry of water and against loss of filler material. At one end the transmission line and safety line conductors extend through the end plug to permit electrical connection to external energizing and safety lines. The general arrangement is depicted in FIGS. 6 and 7.

Four such tubes are employed in the spa of FIG. 1. Each is housed in a respectively associated one of the four side walls of the spa. The energizing and safety circuits of the four tubes are connected in parallel with one another. Portions of two of those circuits are included in FIG. 3. One comprises lamps 64 and 66, power lines 46 and 48, and a safety line 62 which is connected to safety line 30. The other tube circuitry includes lamps 68 and 70, energizing lines 42 and 44, and safety line 30. In the case of each lamp, its filament is connected across the energizing lines, and its safety conductor is connected by the common safety line to system ground.

The physical arrangement of the perimeter lighting lamp houses, or, in this case, tubes, is best shown in FIGS. 6 and 7. Only the end sections are included in FIG. 6. Except for the end plugs and exposed connection, the arrangement of tube, lamps and conductors is the same throughout the length of the tube. Three conductors, 104, 106 and 108, extend from plug 110 at the right of FIG. 6 over the entire length of the tube 100 through the plug 112 at the left end to become three connecting pins for connection to a socket and conductors back to the power transformer. The three lamps shown in FIG. 6 are numbered 114, 116 and 118, respectively. Three conductors extend from the base of each lamp and correspond to the conductors 20, 21 and 22 of lamp 18 of FIG. 2. The safety conductor of each lamp is connected to line 106. The lamp conductors which energize the lamp filament are connected one to line 104 and the other to line 108.

There is no need to insulate the several lamp conductors and the conductor lines individually. They are insulated from one another by the body 120 of semi-cured transparent plastic material with which the whole of the tube interior is filled.

It is a feature of the invention that none of the lamp circuitry need come in contact with the pool or spa water. That is illustrated in the case of the perimeter lighting tubes in FIGS. 4 and 5. Returning to FIG. 1, the numeral 16 identifies a strip of light transmitting material which is bonded to the wall 20 of the spa. The corresponding strip at the adjacent wall 202 is numbered 204. In this spa, the strips 16 and 204 are bonded permanently to the spa walls. At the inner corners where the walls meet, the side wall strip sections are joined by a removable corner strip section. The section that joins strips 16 and 204 is visible in FIG. 1 where it is numbered 206. Those same elements are visible in FIGS. 4 and 5.

As best shown in FIG. 5, the light transmitting strips 16 and 204 and 206 hide what in this embodiment is a V-shaped groove which extends around the entire periphery of the spa wall. The lamp house tubes are disposed in that groove behind the light transmitting strips as tube 210 is shown to be in FIGS. 4 and 5. The end of tube 210 is disposed adjacent to corner piece 206. The other end of the tube extends back to the next corner where it extends through a sealed opening in the spa wall. The corresponding end of tube 212 is shown in FIG. 5. Tube 212 is disposed behind the light transmitting strip 204.

At its connector end, tube 212 extends through a water tight gland 214 which is mounted in the spa wall at a corner enlargement 216 of the V-groove. The flange 220 of a threaded bushing bears against the outer side of the spa wall and is held there by a washer and nut combination 222 at the inner side of the wall. The tube extends through a nut 224, a packing ring contained in nut 224, and through the gland. The nut is threaded on the end of the gland forcing the packing ring to create a seal around the tube.

An inner shoulder of the gland flange 220 serves to hold a connector socket 226 in which the conductor pins of the tube 212 are received.

None of the electrical elements of the tube are exposed to the water. Even the safety conductor lines are isolated from contact with the water. Only if the lamp house wall, the tube, is cut or ruptured and a lamp envelope is broken, does water reach the electrical elements. In that circumstance, if there is a ground fault which results in a potential difference between ground and one of the energy transmission lines, a current path will be formed from the energy transmission line through the ground fault and the spa water back to the energy transmission line. It is possible for a spa user to be included in that circuit and, except for the special safety provisions of the invention, to experience electrical shock. However, the lamp envelope being broken, spa water completes a circuit from the safety conductor to the energizing conductors of the lamp through the ground fault back to the safety conductor line. The path through the pool water is so short as to amount to a short circuit around any circuit in which the pool user may be included. As a consequence, even if the pool user forms part of a circuit that extends in parallel to the path between conductors in the broken lamp, any potential drop across the user and any current flow through the spa user will be insignificant.

The light tube being flexible is easily threaded along the V-groove of the sides behind the light transmitting strips when the corner strip pieces are removed. The packing nut 224 is readily accessible so that the task of installing and removing the perimeter lighting tubes is relatively easy to accomplish.

While other materials may be used to practice the invention, it has been discovered that polyurethane provides unique advantages. Transparent forms of polyurethane have an index of refraction which permits use of a relatively wide range of silcone and other jels and oils and semisolids as the insulating and damping material in the tubular lamp housing to achieve either diffused or undiffused illumination, whichever is desired. Furthermore, the polyurethane lamp house tube can be installed in a spa wall easily and effectively without the need for a protective covering. That is illustrated in FIGS. 8 and 9.

FIG. 8 illustrates a step in the manufacturing process. In FIG. 8 the numeral 300 identifies a portion of the plug mold on which a spa is being formed in a "laying up" process. A section 302 of the spa shell is shown to have already been formed on the plug. In most cases the spa shell is built up of several layers of material to form a sandwich, but the individual layers are not shown because the details of that part of the process are well known and do not form part of the invention.

In this case the plug mold is formed with a groove 304 extending over that part of its periphery which is opposite the path over which the light tube or lamp house is to extend in the finished spa. A length of extruded plastic tubing 306 has part of its shape disposed in the groove 304. As best shown in FIG. 10, the extrusion is circular in cross-section at the left at 308, rectangular in the center at 310 and is reduced to a narrow rib 312 at the right.

Returning to FIG. 8, the rectangular section and the rib are disposed in the groove 304 of the mold. A removable brace 314 bridges the groove which would otherwise divide the mold. The circular portion of the extrusion lies outside the plug mold. That circular portion serves as a part of the plug in the steps of forming the plastic shell over the mold. The mold is coated with a release agent. The inner layer of the spa, the one adjacent the plug, is an acrylic in most cases. It will not adhere to a urethane extrusion, so it may not be necessary to coat the extrusion with a release agent.

The result is shown in FIG. 8. The spa wall is formed around the circular part of the extrusion at 316. Before the shell is removed from the mold, the bridging member 314 is removed. The extrusion is hollow and readily collapsed. One end is pulled free of the spa shell and through the groove 304 by pulling on the rib 312. Thereafter, the entire length of the extrusion is pulled free whereupon the shell is removed from the mold.

The diameter of the circular section 308 of the extrusion is the same as that of the light tube lamp house that is to be installed in the groove thus formed in the shell. That is seen in FIG. 9 where a light tube like those shown in FIGS. 4, 5, 6 and 7 is shown to be installed in the section 316, now turned right side up, of the spa wall 302. The tube is resilient and soft and is distorted and is pushed into the groove with ease. Once installed its renitence urges it back to circular cross-section. There is no way to apply a force to remove the tube short of puncturing it so no adhesive is required to keep it in place. However, coating the inner surface of the groove with a silcone or similar oil will seal the surface behind the tube against the entry of water and will insure against the growth of algae.

In wooden spas and hot tubs, the groove for light tubes is made with a router, and it is not feasible to increase groove width at the interior beyond what it is at the entrance to the groove. Accordingly, adhesive or fastening elements are generally required in the case of wood containers.

In obedience to the rules, the best mode now known for practicing the invention has been shown in the accompanying drawing and described in the specification above. However, it is to be understood that other embodiments and variations of the invention are possible and that the invention is to be limited by what is defined in the appended claims rather than by what has been shown.

I claim:

1. A lamp comprising:

a sealed envelope;

a filament disposed within the envelope;

first and second electrical conductors each extending from a point at the exterior of said envelope through said envelope and each being connected at the interior of the envelope to a respectively associated end of said filament; and a third electrical conductor extending from a point at the exterior of said envelope to the interior of said envelope to a point proximate to but separated from said first and second conductors and said filament and having no internal connection to said first or second conductor and no connection to said filament.

2. The invention defined in claim 1 in which said envelope is formed of glass and in which said first second and third conductors are formed by conductor elements which extend substantially in parallel one to the others through one end of said envelope.

3. The invention defined in claim 2 in which said conductor elements are formed by wires the first and second of which are fixed to respectively associated ends of said filament.

4. In combination:

a plurality of lamps each comprising a sealed envelope, a filament, energizing conductors connected to said filament and extending from the interior to the exterior of the envelope, and a safety conductor unconnected to said filament or the energizing conductors and extending from the interior to said envelope to its exterior;

an electrical power transmission line and a safety conductor line;

means for connecting said energizing conductors in circuit with one another and said transmission line for energizing the filaments of said plurality of lamps; and means for connecting the safety conductor of each lamp of said plurality of lamps to said safety conductor line.

5. The invention defined in claim 4 which further comprises a body of light transmissive electrically insulating material in which said plurality of lamps and said electrical power transmission line and said safety conductor line are disposed.

6. The invention defined in claim 5 which further comprises a lamp housing having a light transmissive wall;

said plurality of lamps, transmission line, safety conductor line, and body of insulating material being contained in said lamp housing such as to substantially fill said housing.

7. The invention defined in claim 6 in which said lamp housing comprises a tube;

said lamps being spaced along a length of the interior of said tube.

8. The invention defined in claim 7 in which said tube is flexible and is formed of polyurethane.

9. The invention defined in claim 6 which futher comprises a container for water having a lamp housing accommodation conformation formed in its interior wall;

the lamp housing being disposed in said conformation.

10. The invention defined in claim 4 which further comprises an electrical power transformer having primary and secondary windings and a frame, a secondary winding being connected to said electrical power transmission line and the frame being connected to said safety conductor line.

11. In an underwater lighting system:

an electrical power line comprising at least two conductors and a grounded return line extending in parallel with the power line;

at least one lamp comprising an enclosure envelope, a pair of conductors extending through said envelope, a filament connected across said pair of conductor at the interior of the enclosure;

means for interconnecting the pair of conductors of the lamp with said power line for energizing the filaments of said lamps; and means in the form of a third electrical conductor associated with the lamp for completing an electrical circuit from said grounded return line to a point proximate to, but not in physical contact with, said pair of conductors of the lamp in the event that the envelope of the lamp is broken.

12. The invention defined in claim 1 in which said electrical power line is insulated from said return line everywhere at the exterior of said envelope.

13. The invention defined in claim 2 which further comprises an enclosure and a body of light transmissive, electrically insulating material contained in said enclosure.

* * * * *